US005414964A

United States Patent [19]

Bodycomb

[11] Patent Number: 5,414,964

[45] Date of Patent: May 16, 1995

[54] FLASHING FOR BUILDINGS

[75] Inventor: Alistair K. Bodycomb, Richmond, Australia

[73] Assignee: Deks Thyer Pty. Ltd., Bayswater, Australia

[21] Appl. No.: 672,749

[22] Filed: Mar. 21, 1991

Related U.S. Application Data

[63] Continuation of Ser. No. 434,596, Nov. 13, 1989, abandoned, which is a continuation of Ser. No. 94,127, Jul. 17, 1987, abandoned.

[30] Foreign Application Priority Data

Nov. 22, 1985 [AU] Australia ..... PH03587

[51] Int. Cl.[6] ..... E04D 13/14; B32B 25/04

[52] U.S. Cl. ..... 52/58; 52/219; 285/42; 428/465

[58] Field of Search ..... 52/218, 219, 199, 200, 52/58; 285/42, 43, 44; 428/461, 465, 466, 358, 122

[56] References Cited

U.S. PATENT DOCUMENTS

| | | | |
|---|---|---|---|
| 3,172,236 | 3/1965 | Weckerly et al. | 52/58 |
| 3,394,044 | 7/1968 | Bright | 428/122 |
| 4,189,877 | 2/1980 | Jentoft et al. | 52/58 |
| 4,304,816 | 12/1981 | Bright et al. | 428/358 |
| 4,333,660 | 6/1982 | Cupit | 285/42 |
| 4,610,907 | 9/1986 | Elvira | 428/122 |
| 4,655,009 | 4/1987 | De Graan | 52/58 |
| 4,664,390 | 5/1987 | Houseman | 52/58 |

FOREIGN PATENT DOCUMENTS

| | | | |
|---|---|---|---|
| 123141 | 3/1984 | European Pat. Off. . | |
| 2951275 | 7/1981 | Germany | 52/219 |
| 549711 | 5/1974 | Switzerland . | |
| 1014439 | 12/1965 | United Kingdom | 52/219 |
| 1080837 | 8/1967 | United Kingdom | 52/219 |
| 1310059 | 3/1973 | United Kingdom . | |
| 1573707 | 8/1980 | United Kingdom . | |
| 2156919 | 10/1985 | United Kingdom . | |

*Primary Examiner*—Michael Safavi
*Attorney, Agent, or Firm*—Richard T. Laughlin; Ribis, Graham & Curtin

[57] ABSTRACT

A flashing product (10) being an elongated flashing strip (20) made of resilient material having a member or members (21) attached to one marginal edge portion (22) of the flashing strip and extending in the direction of elongation thereof. The member or members (21) each being a metal strip having slits or slots (23, 24) formed therein extending from opposite edges of the metal strip (21) in a direction across the direction of elongation so that the metal strip or strips may be non-resiliently stretched in the direction of elongation and when so stretched is capable of maintaining the marginal edge portion of the resilient material correspondingly stretched.

16 Claims, 3 Drawing Sheets

FLASHING FOR BUILDINGS

This application is a continuation of application Ser. No. 434,596, filed Nov. 13, 1989, which is a continuation of Ser. No. 94,127, filed 7/17/87, now both abandoned.

This invention relates to flashing used in buildings to provide a seal between a surface and a member projecting therefrom. The invention is particularly applicable to providing a seal between a roof structure or wall of a building and a member or structure passing therethrough, projecting therefrom, or adjacent thereto.

Historically, lead or soft malleable metals in sheet form have been used as a flashing material in buildings because of the ease of deforming the material to follow the irregular contour usually presented by the surface of the roofing material, and in the case of lead, because of its ability to be conveniently stretched on site if required. The fashioning of the flashing on site to suit individual situations requires considerable skill by the workman in order to ensure an effective seal is achieved, and was a relatively time consuming and therefore costly operation.

More recently, there has been a trend towards using rubber or like resilient deformable materials as a substitute for lead, and to prefabricate flashing devices from such materials in a manner to reduce the skill and labour involved in installing same. However, such materials have the disadvantage that due to their resilience they do not readily conform to, and maintain contact with, the surface of the roof or like to which it is to be fitted, without the use of associated components of non-resilient material.

It is therefore the object of the present invention to provide an improved flashing product, particularly for use in buildings, which is effective in operation, convenient to install, and reduces the skill and labour involved in installation thereof.

With this object in view, there is provided a flashing product incorporating a section made of a deformable resilient material and having attached to a portion of that section a member or members adapted to be manually stretch in at least one direction and when so stretched to be capable of maintaining said portion of resilient material correspondingly stretched.

Conveniently, the adaption of the member to be stretched in one direction is such that compressing of the member may also be effected. In particular the adaption of the member may be such that it may be stretched along one edge and compressed along the opposite edge. This enables a portion of the member to be manually deformed in the plane thereof into an arcuate or curved form. The member or members are also manually deformable in the direction normal to the plane thereof so that it may be contoured along its length. This contouring of the member may be effected independently or in combination with stretching or compressing of the member.

Conveniently, the member is provided with a plurality of interruption along at least one edge extending substantially in said direction of desired stretch, whereby the member is stretched by increasing the width of the interruption at least along part of the length of the member. Preferably, interruptions are provided along each of two opposite edges of the member with alternate interruption extending from opposite edges of the member. The interruptions preferably extended from the opposite edges more than half the width of the member, or at least overlap one another in the direction of the width of the member. Preferably, the interruptions extend across the major part of the width of the member, up to about 75% to 90% of the width of the member.

Conveniently, the interruption may be of a shape being wider at the edge of the member from which they extend, such as of a V shape.

The non-resilient member may be of a soft metal that is manually deformable such as aluminium, zinc plate, or steel, the steel being preferably galvanised or coated to resist corrosion. The member is preferably of a strip form with a thickness of the order of ½ to 2 mm, conveniently about 1 mm, to provide the degree of rigidity necessary to hold the resilient material in the stretched or compressed condition.

The non-resilient member may be attached to the deformable resilient material by bonding to one face of the resilient material, either in a superimposed or inlaid relation having one face of the member exposed. Alternatively, the member may be embedded in the resilient material. When the member is embedded in the resilient material it is preferably that at least one face of the member be bonded to the resilient material.

The member or non members may be strips of metal with slots, notches, or slits extending in from one or both longitudinal edges of the strip. The degree of stretch that the member may achieve without failure is increased with the length and member of the slots, notches, or slits in the member.

When it is required to increase the length of the strip or sheet in the area that the member or members are attached the application of a tension force in the direction of the length of the member will cause the slots or slits to open to increase the width of the slots or slits, with a resultant stretch of the resilient material spanning the slot or slit. Because of the generally non-resilient nature of the material of the member or members they will retain the stretched state when the tension force is released.

It many flashing products, the non-resilient member or members are attached to a marginal edge portion of the product so that the edge portion may be shaped and/or contoured to closely follow the surface to which the flashing product is being fitted. In such products the marginal edge portion is required to establish a sealed relation with the surface to which it is being fitted, and so after suitable shaping of the marginal edge portion, suitable fastenings, such as bolts, screws or rivets, are used to secure same together with the resilient material compressed between the non-resilient member and the surface to which the flashing product is fitted.

With slots or slits extending in from opposite edges of the member or members if the slits or slots are generally equally stretched the edge of the strip will remain generally straight in the plane of the strip. However, the edge of the strip may be curved by stretching one edge of the member more than the other, or by stretching one edge and compressing the other.

In one preferred embodiment the non-resilient members are in the form of a zig-zag or wave shaped strip. Conveniently, the strips are arranged in a nested relation without actual contact between adjacent strips when attached to the resilient material. The greater the spacing of the members the greater the maximum degree of stretch, but the degree of retention of deformation may be somewhat reduced.

The use of the zig-zag or wave form in a plurality of members attached to a single sheet or strip of resilient material permits stretching in multi directions and deformnation in multi orientations.

in one form the flashing product is a flashing strip comprising an elongated strip of rubber or like resilient material having along the opposite longitudinal edge portions a metallic strip. Each metallic strip has slits or slots extending transversely thereof with alternate slits or slots extending from opposite edges of the metallic strip. The metallic strips are preferably between about 25 to 35 mm wide and 0.75 to 1.5 mm thick and are embedded in the rubber.

This flashing strip may be used to flash the junction between a generally flat surface and a non-planar surface, such as .the junction of a roof with an upright surface of a wall or structure. The slotted or slit metal strip enables the edge portion in which it is embedded to be longitudinally-stretched and/or deformed to closely follow the contour of the roof without undue tucks or folds in the flashing strip.

The invention will be more readily understood from the following description of several practical arrangement of products incorporating the present invention as illustrated in the accompanying drawings.

Figure 1:
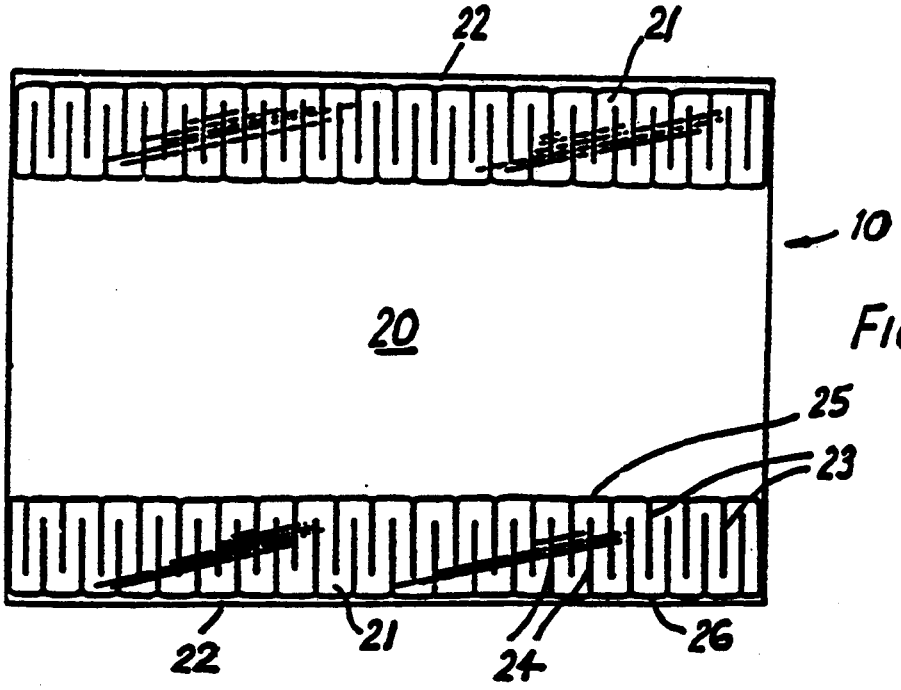
FIG. 1 is a perspective view of portion of a flashing strip.

Referring now to FIG. 1 there is illustrated a flashing strip for use in providing a seal between two intersecting surfaces such as a roof and wall or structure projecting therefrom. The flashing strip 10 is comprised of an elongated sheet or strip 20 of rubber or like resilient material having suitable physical properties for outdoor use, particularly extended exposure to sunlight. Each longitudinal marginal edge portion 22 of the sheet 20 has a metal strip 21 bonded to the surface thereof on the same side of the sheet. Each metal strip 21 has a series of slits or slots 23, 24 therein extending inwardly from the respective edges 25, 26 of the strip. The construction of the strip 21 is more clearly shown in FIG. 2 wherein the same reference numeral as used in FIG. 1 apply.

The strip 21 is manufactured as a continuous band with the slots 23 and 24, extending from the opposite edges 25 and 26, alternating. At the junction of the slots with the edges of the strip the corners are radiused at 30 to reduce the risk that the corners may pierce the rubber sheet, and so create a leak or even promote tearing of the rubber sheet. Also the base of the slots 23 and 24 are radiused at 31 to reduce the risk of the metal of the strip tearing when the strip is stretched.

In a typical arrangement of the flashing strip 10 the strips 21 are made of an aluminium alloy of a thickness of 1 mm and a width of 25 mm. The slots 23, 25 are of a width of 1.5 mm and a length of 18 mm. The rubber of which the sheet 20 is preferably an EPDM rubber with a hardness preferable less than 40 Durometer.

The flashing strip 10 as shown in FIG. 1 has the strips 21 bonded to the surface of the rubber sheet 20, and this is achieved by applying a coating of bond primer to at least the surface of the strip that will contact the sheet 20, and then bring the primed surface of the strips into contact with the sheet 20 in the uncured state. Preferably the sheet and strips are pressed together such as by passing through rollers to inlay the strips into the sheet with the rubber filling the slots 23, 24 in the strips. The resulting assembly is then cured.

It is to be understood that a flashing strip as shown in FIG. 1 may also be made with the metal strips 23 and 24 completely embedded in the marginal edge portions of the rubber sheet 20. This construction is particularly desirable for aesthetic reasons. In many applications of the flashing strip 10 the degree of stretching of the metal strip may vary from one location to another, and the resultant irregular appearance of the metal strips as would be exhibited by the construction shown in FIG. 1 may be considered objectionable. This irregularity is concealed if the strips 23 and 24 are completely embedded in the rubber sheet.

The construction of the flashing strip 10 with embedded metal strips 21 may be effected by laying up the primer coated metal strips 21 between layers of uncured rubber and holding them in assembly under pressure and heating to effect curing. An alternative method is to extrude the rubber sheet 20 with the metal strips 23 and 24 embedded in the marginal edge portions of the extruded sheet and then cure the resulting assembly. The extruded assembly can be rolled and cured in an autoclave, and so renders this method of construction advantageous for high volume production.

As previously described the flashing strip 10 has a slotted metal strip 21 in each marginal edge portion, however in some applications a slotted metal strip may be located in only one marginal edge portion, the opposite edge portion may be wholly of rubber or may have a solid un-slotted metal strip therein. The un-slotted strip may be bonded to the surface of or embedded in the rubber sheet in the manner as previously described in relation to the slotted strips.

Figure 6:
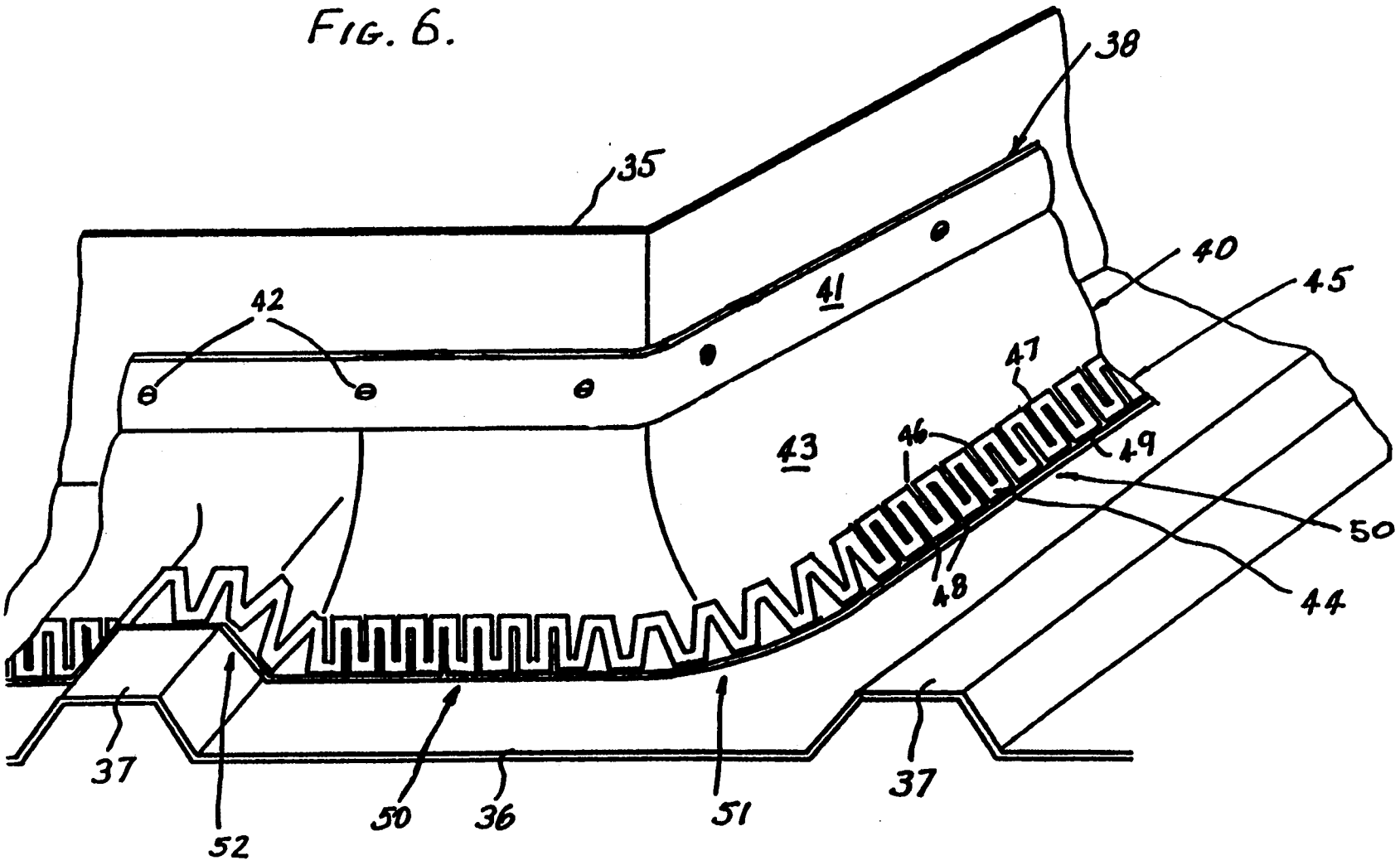
FIG. 6 is a perspective view of a skylight installation incorporating the flashing strip.

When the flashing strip 10 as described above with reference to FIGS. 1 and 2 is in use it is frequently necessary for part of one of the marginal edge portions to increased in length such as when the flashing strip is required to extend around a corner of a structure projecting from a roof, such as a skylight structure. This use of the flashing strip is illustrated in FIG. 6 of the accompanying drawing. The skylight structure 35, shown in part, projects from the sheet metal roof 36 having a series of stiffening ridges 37 extending up the slope of the roof. It is to be understood that only part of the skylight structure is shown in FIG. 6 representing one corner of that structure.

The marginal edge portion 38 of the flashing strip 40 has a continuous unslotted metal strip 41 bonded thereto, as edge portion 38 is not required to be stretched or compressed in order to be fitted around the perimeter of the skylight structure. The marginal edge portion 38 is secured to the skylight structure 35 at regular intervals by screws 42 so that the rubber is compressed between the strip 41 and to skylight structure 35 to provide a weather tight seal.

Figure 2:
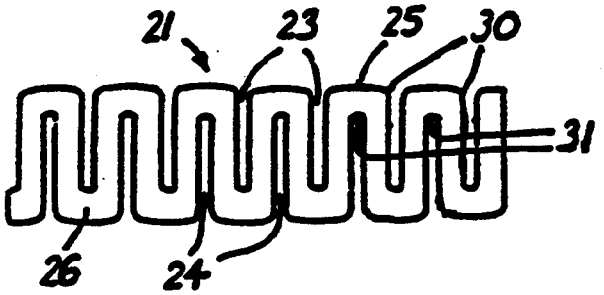
FIG. 2 is a view of a portion of the type of metal strip used in the flashing strip shown in FIG. 1.
Figure 3:
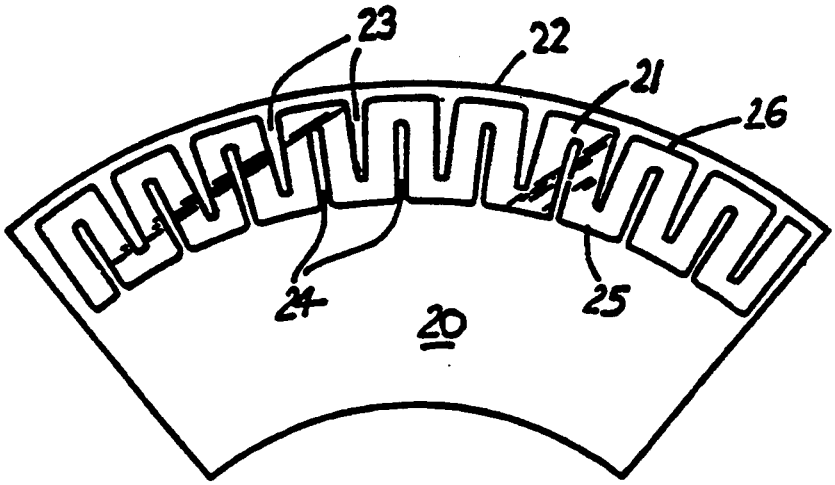
FIG. 3 is an enlarged view of a portion of the flashing strip shown in FIG. 1 formed into a curved shape.

The rubber sheet portion 43 of the flashing strip curve outwardly and downwardly from the marginal edge portion 38 to the opposite marginal edge portion 45 which lies on the surface of the roof sheet 36. The metal strip 44 of the edge portion 45 is provided with a series of slots 46 along its inner edge 47 and series of slots 48 along its outer edge 49. The slots 46 and 48 are of the form and are arranged as previously described in respect to the slots 23 and 24 as shown in FIGS. 1 and 2. In those areas of the edge portion 45 that are straight and lie flat on the roof sheet, as indicated at 50, the slots 46 and 48 are not stretched or compressed and so the slots are of uniform width throughout their length, that is as formed.

In the corner area 51 the marginal portion 45 must be increased in length to accommodate the arcuate path it must follow around the corner of the skylight structure while remaining flat on the surface of the roof sheet. This increase in length is obtained by stretching the metal strip 44 by opening the slots 46 and 48 with the outer slots 48 being opened wider than the inner slots 46 to establish the curved shape. Because of the relative strength of the metal strip 44 and the rubber sheet 43, once the metal strip 44 and the portion of the rubber sheet, attached thereto have been stretched the strip 44 will retain its stretched state and also will hold the attached portion of the rubber sheet in the stretched state.

In order for the marginal portion 45 to pass over the ridge 37 in the area 52 there must also be an increase in the length of the marginal portion 45 by a stretching of the metal strip 44. As the strip is not required to follow a curved path in this area, the inner and outer slots 46 and 48 are each opened by generally the same amount.

The above stretching and bending of the slotted metal strip 46 enables the marginal portion 45 to be shaped to be passed around corners and over ridges or through valleys, and maintain close face to face contact with the roof sheet 36. Accordingly, when appropriately spaced screws are applied to fasten the marginal edge portion 45 to the roof sheet the rubber is compressed between the strip 44 and the roof sheet 36 to provide a weather tight seal therebetween.

The ability to increase the length of the marginal edge portion of the flashing strip in selected location, and to selected degrees, enables the flashing strip to be fitted to non planar and irregular surface and in doing so establish an effective sealing relation therewith. In addition the stretching and bending of the flashing strip is achieved without development of major folds, pleats or tucks in the rubber sheet that may provide an area for collection of water, and present an untidy appearance.

Figure 4:
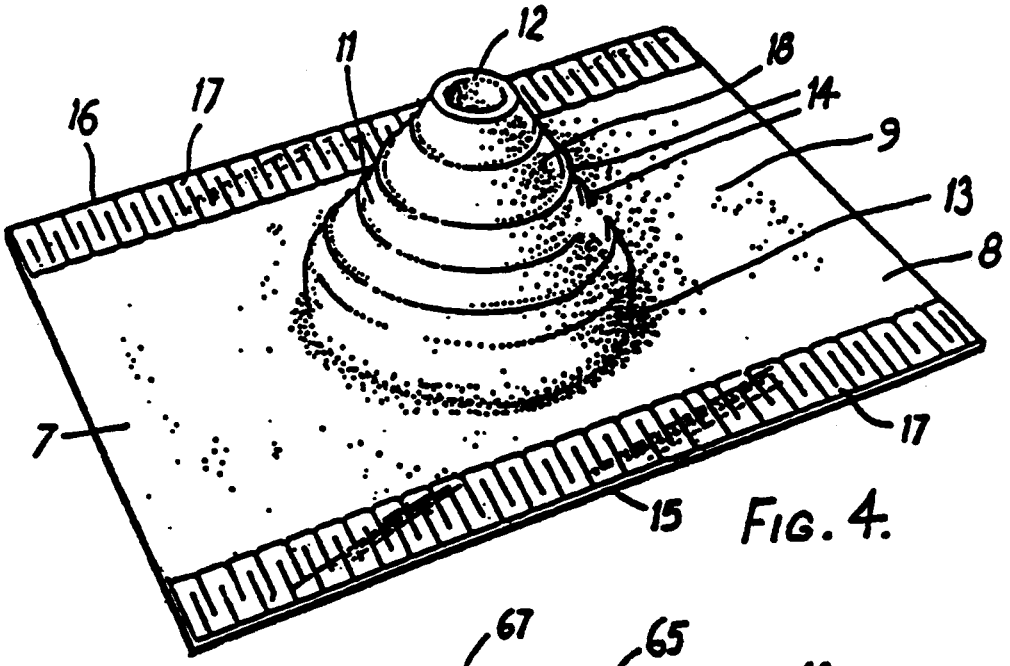
FIG. 4 is a perspective view of a known type of sealing device modified to incorporate the present invention.

FIG. 4 in the drawing illustrates a sealing device specifically designed to provide a seal between a pipe or duct projecting through a roof made of ridged sheet material. The seal device comprises a flange 9 of resilient readily deformable material, such as natural or synthetic rubber, having an integral sleeve 11 extending from the upper face of the flange. The sleeve 11 has a tapered portion 18 tapering toward the upper free end 12, and at the lower end has a generally cylindrical portion 13 that connects the tapered portion 18 to the flange 9. The flange 9 has a aperture therein, (not shown) that is co-axial with and communicates with the bore of the sleeve 11. In use the pipe or duct will pass through the aperture and sleeve.

The wall of the cylindrical portion 13 is preferably somewhat thicker than the adjacent portion of the flange 9 and tapered portion 18 to provide greater resistance to distortion in use.

The junction areas between the cylindrical portion 13 and the flange 9 and tapered portion 18 are sufficiently flexible to accommodate misalignment of the cylindrical portion relative to the other parts of the seal device, as may be necessary in normal use. Spaced along the tapered portion 18 are a plurality of external ridges 14 denoting where the sleeve may be cut off to suit elongate members of different diameters. The ridges also provide a reinforcement about the edge of the open end of the sleeve so formed.

The general construction of the sleeve 11 with another form of flange has been proposed in U.S. patent application No. 723,035 and which was developed within the same corporation as the present invention.

The opposite marginal edge portions 15 and 16 of the flange 9 have bonded thereto the metal strips 17 that extend the length of the flange. The metal strips 17 are each of the construction of the strips 21 as previously described with reference to FIGS. 1 and 2 of the drawing and may be stretched, compressed, or contoured in the same manner.

The metal strips 17 are bonded to the upper surface of the flange 9 in the embodiment as shown, however if desired may be embedded within the flange as previously referred to in respect of other embodiments.

In use the seal device as shown in FIG. 4 is fitted to a pipe or duct extending through a roof sheet by cutting the sleeve 11 off at the ridge 14 appropriate to the size of the pipe or duct, and inserting the pipe or duct through the flange 9 and sleeve 11 so the flange will lie on the upper surface of the roof sheet. As is known, roof sheets have spaced longitudinal ribs or ridges to impart the required strength thereto, and the flange 9 of the sealing device must be attached in a sealed relation thereto. The metal strips 17, which extend across these ribs when the seal device is assembled to the pipe or duct, may be stretched and contoured so that the edge portions 15 and 16 of the flange 9 may closely follow the contour of the roof without resulting in substantial folds and disturbances in the area of the flange between the edge portions 15 and 16 and the sleeve 11. Screws, rivets or like fastenings are applied to attach the edge portions to the roof sheet so the rubber of the flange 9 is compressed between the respective strips 17 and the roof sheet to establish the weather tight seal therebetween.

No metal strip is attached to the edge portions 7 and 8 of the flange 9 so as to contribute to the freedom of movement of the flange material to avoid the formation of folds during installation. However, separate metal strips not shown are preferably fitted using suitable fastenings to compress the edge portions 7 and 8 adjacent the roof sheet after fixing of the metal strips 17 to the roof sheet has been completed.

Figure 5:
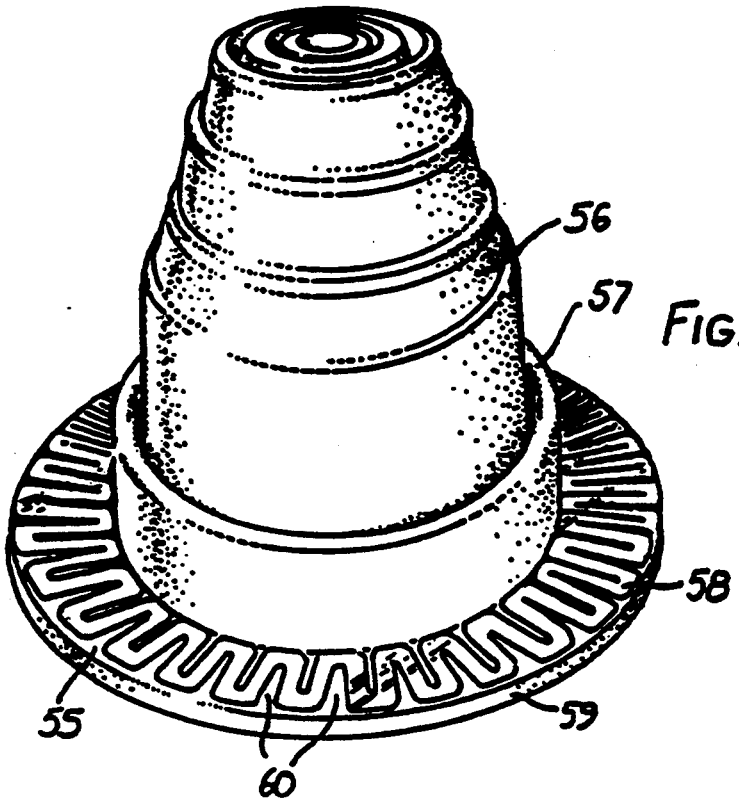
FIG. 5 is a perspective view of another known type of sealing device modified to incorporate the present invention.

An alternative form of seal device is shown in FIG. 5, which is similar to that described above with reference to FIG. 4, but has a relatively narrow annular flange 55 and is an adaption of the present invention to the seal device the subject of U.S. Pat. No. 4,333,660. The sleeve 56 is of the same general form as described With reference to FIG. 4 and will not be further described. Between the lower end of the sleeve 56 and the flange 55 is a re-entrant skirt 57 which provides a substantial degree of flexibility between the sleeve and the flange to accommodate misalignment encountered when fitting the seal device to a pipe projecting through a roof. This flexibility reduces the degree of distortion of the sleeve and flange that may otherwise be necessary to accommodate such misalignment.

The annular flange 55 has a lower portion 59 of rubber formed integral with the skirt 57 and an upper metal strip 58 bonded to the upper face of the lower portion 59. In an alternative construction the metal strip 58 may be embedded in the rubber of the lower portion. The metal strip 58 is of an annular shape complementary to the lower portion 59 and has slots 60 extending in from each of the inner and outer edges of the strip. The form and arrangement of the slots 60 are the same as previously described in respect of the metal strips illustrated in FIGS. 1 and 2, and provide the same capacity to be stretched or compressed to impart a desired shape or contour to the flange 55 when being installed to a non-planar roof or other surface. The flange is secured in position by suitably located fastenings such as screws, bolts or rivets that pass through the flange 55.

The metal strip 58 as incorporated in the seal device shown in FIG. 5 may be stamped from a flat sheet of metal with the slots 60 being formed in the same operation as the profile of the straight form and then further worked into the annular shape. The rubber flange may have the metal strip 58 bonded thereto as a separate operation after final forming of the flange, or the metal strip 58, in an annular form, may be located in a die and the flange 55 and sleeve 56 then moulded in that die to thereby bond the metal strip to the flange.

The metal strip 21 as previously described may be produced in a stamping operation, or by suitable rolls that will form the series of slots of the shape and formation previously described. Alternatively, a wire or rod of the suitable metal may be formed into a sinuate shape and then the wire or rods is pressed flat such as by passing through rollers to form a strip as described with reference to FIG. 2. The pitch and amplitude of the sinuate shape is selected, having regard to the wire or rod diameter, to give the required slot form and spacing after being flattened. In some constructions the sinuate wire or rod may be used in an un-flattened state.

It will be appreciated that the metal strip may be formed by other known metal working techniques and the invention is not limited to the specific techniques discussed herein. Also the form of the strip and the interruption therein may take forms, other than those specifically referred to herein, that will impart the non-resilient deformability to the strip to permit the manual stretching and compressing thereof.

Figure 7:
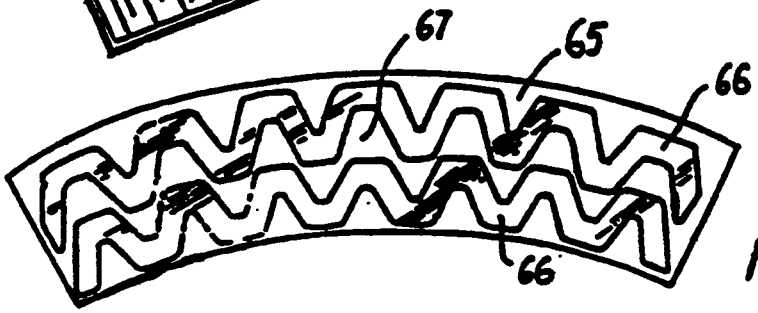
FIG. 7 is a view of a further modification of the present invention.

FIG. 7 of the drawings show a rubber strip 65 having two strips 66 of non-resilient material bonded to one face thereof. The strips 66 are each of a sinuate form and are arranged in a nesting relationship, but spaced so that the strips are not in contact with each other, thus forming a sinuate band 67 of rubber between the two metal strips 66. In this construction, in addition to each strip 66 being stretchable in the direction of the length of the strip, by appropriate variation in the deformation of each strip 66 a degree of shaping of the rubber strip 65 in the transverse direction can be obtained. It is also to be understood that the number of metal strips arranged in the nested relation may be increased so as to form a sheet rather than a strip of rubber, that may be manually deformed and will retain that deformed condition.

The claims defining the invention are as follows:

1. A building flashing product to produce a water seal comprising an elongate member of a flexible resiliently deformable material and a generally planar strip of non-resilient, manually deformable material, said non-resilient material being of a construction to be manually stretchable in the longitudinal direction of an edge portion of the member and when so stretched to be capable of maintaining said edge portion correspondingly stretched in use, said planar strip extending along one longitudinal edge portion of the elongate member and intimately secured thereto throughout the length of the strip.

2. The flashing product as claimed in claim 1, wherein the strip is non-resiliently deformable in a direction substantially normal to the plane of the strip to impart a contour to said edge portion of the member.

3. The flashing product as claimed in claim 1 wherein the strip is non-resiliently deformable in the plane thereof in a direction substantially transverse to the longitudinal direction of stretch of the strip to impart a contour to said edge portion of the member.

4. The flashing product as claimed in claim 1 wherein the strip is embedded in the member and bonded thereto.

5. The flashing product as claimed in claim 1, wherein the strip is non-resiliently deformable in a direction substantially normal to the plane of the strip and in a direction substantially transverse to the longitudinal direction of stretch of the strip to impart a contour to said edge portion of the member in each said direction.

6. The flashing product as claimed in claim 1, wherein the strip is a metal strip having slots formed therein extending from an edge of the strip in a direction across the direction of stretch of the strip.

7. The flashing product as claimed in claim 1, wherein the strip is a metal strip having slots extending from each of two opposite edges of the strip in a direction across the strip, the slots extending from one edge of the strip being offset in the direction of the length of the strip from adjacent slots extending from the opposite edge of the strip.

8. The flashing product as claimed in claim 1, wherein the strip is a metal strip having slots extending from each of two opposite edges of the strip in a direction across the strip, the slots extending from one edge of the strip being offset in the direction of the length of the strip from adjacent slots extending from the opposite edge of the strip, the slots from each of said edges extending across the strip more than half the width of the strip.

9. The flashing product as claimed in claim 1, wherein the strip is a metal strip having slots extending from each of two opposite edges of the strip in a direction across the strip, the slots extending from one edge of the strip being offset in the direction of the length of the strip from adjacent slots extending from the opposite edge of the strip and the slots extend across the strip more than 75% of the width of the strip.

10. The flashing product as claimed in claim 1, wherein the strip is formed by a sinuate metal wire.

11. The flashing product as claim in claim 1, wherein there is one said strip secured to each marginal edge portion of the two opposite elongate edges of the elongated member.

12. The flashing product as claim in claim 1, wherein the strip is a metal strip having slots extending from each of two opposite edges of the strip in a direction across the strip, the slots extending from one edge of the strip being offset in the direction of the length of the strip from adjacent slots extending from the opposite edge of the strip, and wherein there is one said strip secured to each marginal edge portion of the two opposite elongate edges of the elongated member.

13. The flashing produce as claimed in claim 1, wherein the elongated member has a further planar strip of non-resiliently deformable material extending along and secured to the opposite edge portion thereof throughout the length of the strip and extending in the direction of the elongation of the member, said further strip being stretchable in the direction of elongation of the member.

14. A flashing product to provide a weather seal between an elongate member and a non-planar surface of a building roof or wall sheet through which the elongate member projects, said seal device comprising an apertured base member of resiliently deformable material, a sleeve of resiliently deformable material integral with the base member and projecting from one side thereof, said sleeve enclosing the aperture in the base member so that in use the elongate member extends through said aperture and sleeve, the sleeve having an end remote from the base member adapted to in use sealably engage the exterior of the elongate member, said base member having a marginal edge portion to be located in use in superimposed relation to the non-planar surface, a substantially planar strip of non-resilient material secured in overlying relation to said marginal edge portion along the length of the strip, said strip being of a construction to be non-resiliently manually stretched in the direction of extent of said marginal edge portion so that when stretched the strip will maintain said marginal edge portion correspondingly stretched.

15. A flashing product as claimed in claim 14, wherein the base member is an annular flange co-axial with the sleeve and the strip is of annular shape extending along the marginal edge portion of the annular flange.

16. A flashing product as claimed in claim 14, wherein the base member is a generally rectangular shape and said strip extends along the marginal edge portion of at least one side of said rectangular base member.

* * * * *